US008759701B2

(12) United States Patent
Lee

(10) Patent No.: US 8,759,701 B2
(45) Date of Patent: Jun. 24, 2014

(54) SWITCH APPARATUS

(75) Inventor: Tsung-Shih Lee, New Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 286 days.

(21) Appl. No.: 13/420,604

(22) Filed: Mar. 14, 2012

(65) Prior Publication Data

US 2013/0240338 A1 Sep. 19, 2013

(51) Int. Cl.
*H01H 3/12* (2006.01)
*H01H 13/14* (2006.01)

(52) U.S. Cl.
USPC ..... 200/341

(58) Field of Classification Search
USPC ..... 200/341, 600, 6 R, 400, 402, 406, 520, 200/282, 283, 333, 335, 337, 343
See application file for complete search history.

(56) References Cited

U.S. PATENT DOCUMENTS 6,664,491 B2 * 12/2003 Yanai et al. ..... 200/516
2005/0224329 A1 * 10/2005 Milo ..... 200/341

* cited by examiner

*Primary Examiner* — Edwin A. Leon
*Assistant Examiner* — Anthony R. Jimenez
(74) *Attorney, Agent, or Firm* — Cheng-Ju Chiang

(57) ABSTRACT

A switch apparatus adapted to be assembled with a casing of an electronic product, the switch apparatus includes a control device having a base portion, a position portion, at least a pressing portion, and a linking portion having one end connected to the casing. A resilient element is installed in the control device, and has a fixing portion fixed into the position portion, and at least a deforming portion and a contact portion. At least a triggering device is electrically connected with the printed circuit board. When the control device is being pressed with a first force, the triggering device is being pushed downwards by the contact portion, while the control device is being pressed with a second force larger than the first force, the at least a deforming portion deforms, and the contact portion continuing pressing against the triggering device.

10 Claims, 6 Drawing Sheets

SWITCH APPARATUS

BACKGROUND OF THE INVENTION

1. Field of the Invention

The present invention relates to a switch, and particularly to a switch apparatus having double buffering structures which are capable of buffering and withstanding a force applied on the switch apparatus so as to prevent the switch apparatus from damage.

2. Related Art

Generally, electronic products are provided with switches to switch on or off. In other words, if the switches are broken or damaged, the electronic products cannot work. Hence, switches are very important to electronic products.

A conventional switch includes a switch button and a trigger. The switch button is generally controlled to press the trigger for switching on or off. However, if the switch button is pressed with excessive force, the switch is apt to be damaged, and such a problem especially and easily arises in compact electronic products, like mobile phones. Therefore, to overcome the aforementioned problem, a soft object is provided between the switch button and the trigger for reducing the impact to the trigger. However, when the switch button is pressed, the soft object is deformed immediately and only on where it receives the impact from the switch button, which causes the trigger receives an unbalanced force. As a result, users have to apply different forces on different portions of the switch button to switch on or off. And it makes the switching difficult and not smooth. Besides, the soft object only can soft a small impact, but still becomes malfunction according to a big impact.

SUMMARY OF THE INVENTION

Accordingly, an object of the present invention is to provide a switch apparatus having double buffering structures for separately buffering and withstanding a force applied on the switch apparatus.

To achieve the above object, the present invention provides a switch apparatus, which is adapted to be assembled with a casing of an electronic product. The switch apparatus comprising a control device comprising a base portion having two opposite end portions, an opening, an accommodating space communicating with the opening and defined in the base portion, a position portion, at least a pressing portion formed on a side of the base portion adjacent to the opening, and at least a linking portion having one end connected to the casing of the electronic product; a resilient element being installed in the control device, and having a fixing portion, at least a deforming portion and a contact portion extending from a free end of the at least a deforming portion, the fixing portion being fixed into the position portion and bent to form the at least a deforming portion, the at least a contact portion located with respect to the pressing portion of the control device; and at least a triggering device being electrically connected with the electronic product, and having a bearing surface facing the contact portion of the resilient element.

To achieve the above object, the switch apparatus of the present invention further comprises two retaining elements located below the two end portions of the base portion, respectively, and each of the retaining elements has a retaining face located lower than the bearing surface of the at least a triggering device.

With the above-mentioned structure, when the control device is being pressed with a first force, the at least a pressing portion presses against the contact portion of the resilient element, whereby the bearing surface of the at least a triggering device is being pushed downwards by the contact portion so as to trigger the at least a triggering device, while the control device is being pressed with a second force larger than the first force, the at least a deforming portion deforms, the contact portion continues pressing against the bearing surface, and the end portion moves against the retaining face.

DESCRIPTION OF THE PREFERRED EMBODIMENTS

Figure 7:
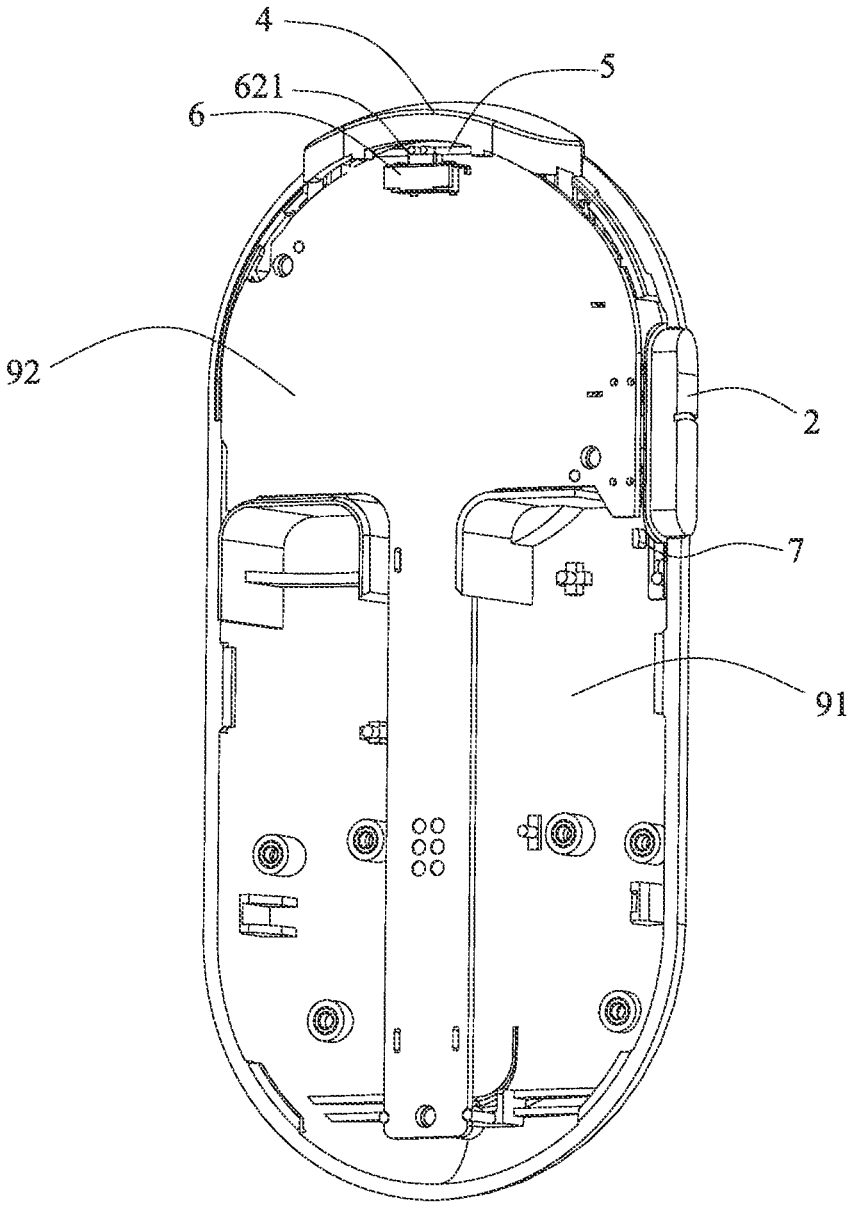
FIG. 7 is another schematic perspective of FIG. 5, with a printed circuit board attached thereto.

A switch apparatus 1 of the present invention is adapted to be assembled with a casing 91 of an electronic product equipped with a printed circuit board 92 (as shown in FIG. 7) for switching on or off the power, adjusting the volume or the brightness of a screen, and so on, wherein the electronic product, for instance, is a mobile phone.

Figure 1:
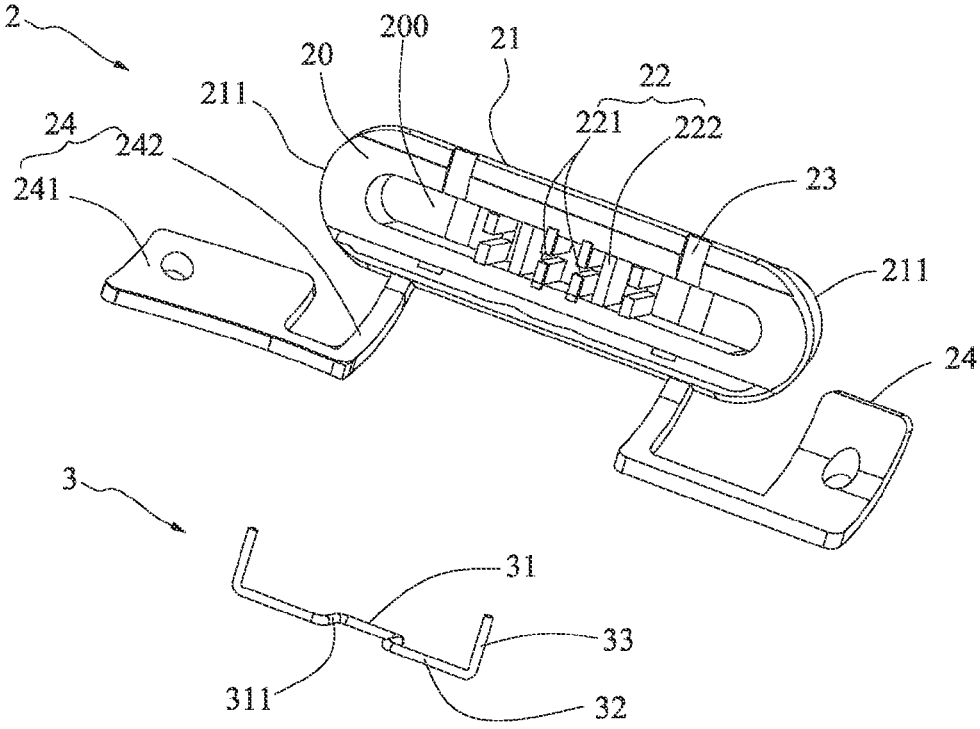
FIG. 1 is a schematic exploded perspective view showing a control device and a resilient element of a first embodiment of a switch apparatus of the present invention.
Figure 2:
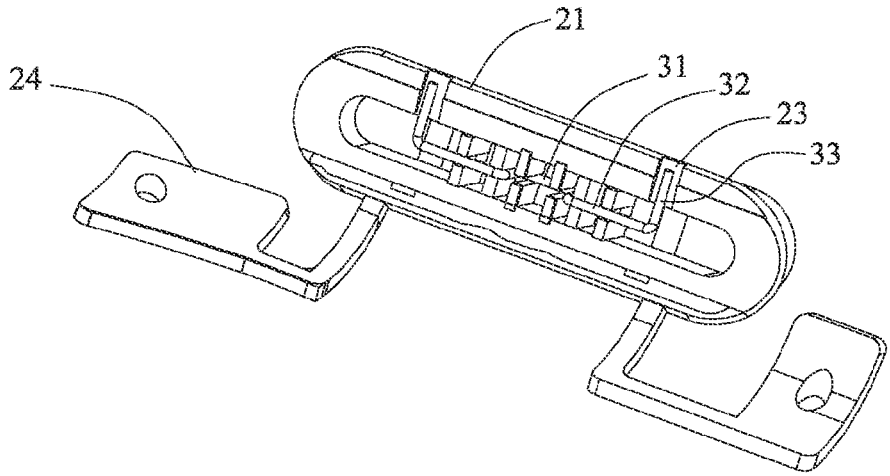
FIG. 2 is a perspective assembly view of FIG. 1.
Figure 5:
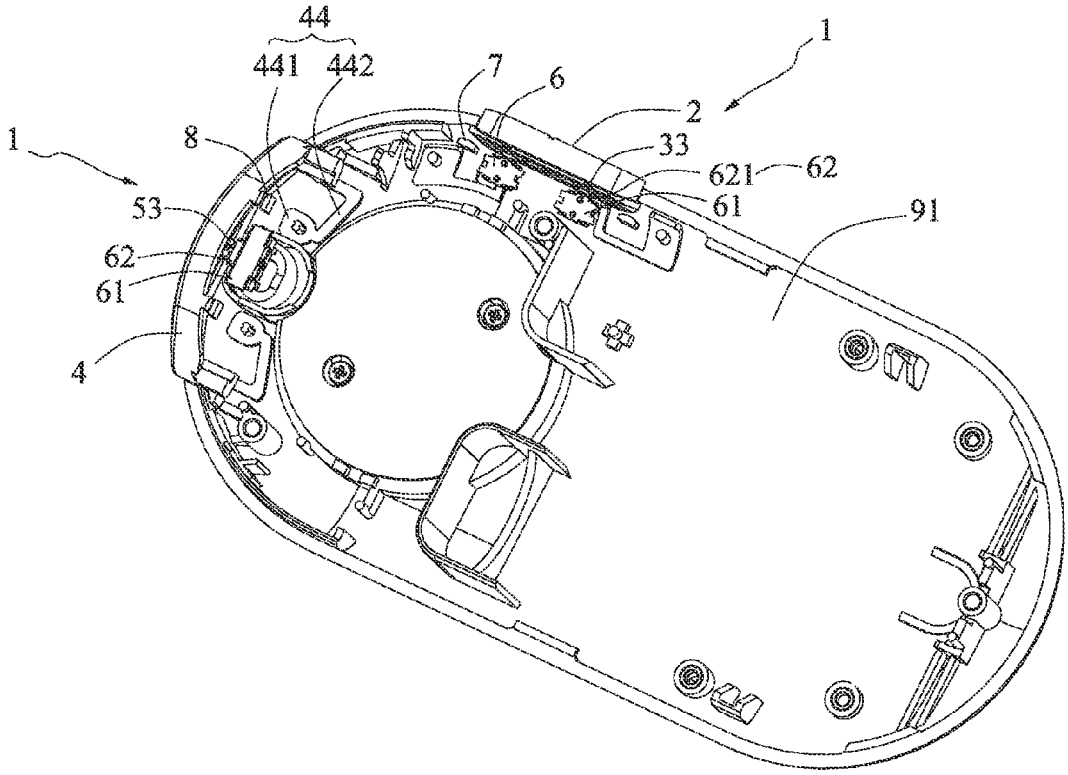
FIG. 5 is a schematic perspective view showing the switch apparatus of the present invention being assembled with a casing of an electronic product.

Referring to FIGS. 1 and 2 showing a first embodiment of the switch apparatus 1 of the present invention, the switch apparatus 1 comprises a control device 2, a resilient element 3, two triggering devices 6, and two retaining elements 7. The control device 2 has a base portion 21, an opening 20, an accommodating space 200 communicating with the opening 20, a position portion 22, two pressing portions 23, and two linking portions 24. The base portion 21 has two opposite end portions 211, the accommodating space 200 is defined in the base portion 21, and the two pressing portions 23 are being recessed from a side of the base portion 21 adjacent to the opening 20 and the end portions 211, respectively. The position portion 22 is formed in the accommodating space 200, and has multiple position slots 221 and supporting walls 222, which are spaced away from each other. The control device 2 is disposed in a corresponding cavity (not labeled) formed on the casing 91 (as shown in FIGS. 5 and 7), and is surround by the cavity and spaced slightly apart from it.

The two linking portions 24 are connected to a lateral edge of the base portion 21 at a same side, respectively. Each of the linking portions 24 comprises a fixing plate 241 and a linking bar 242 bending to form a substantially L shape, wherein one end of the linking bar 242 is connected to the fixing plate 241 that is firmly fixed onto the casing 91 of the electronic product (as shown in FIG. 5), and the other end of the linking bar 242 is connected to the base portion 21 and remains free together with the base portion 21. In the above manner, the linking bar 242 and the base portion 21 cooperatively forms a cantilever structure so that the base portion 21 is capable of being pressed downwards.

Figure 4:
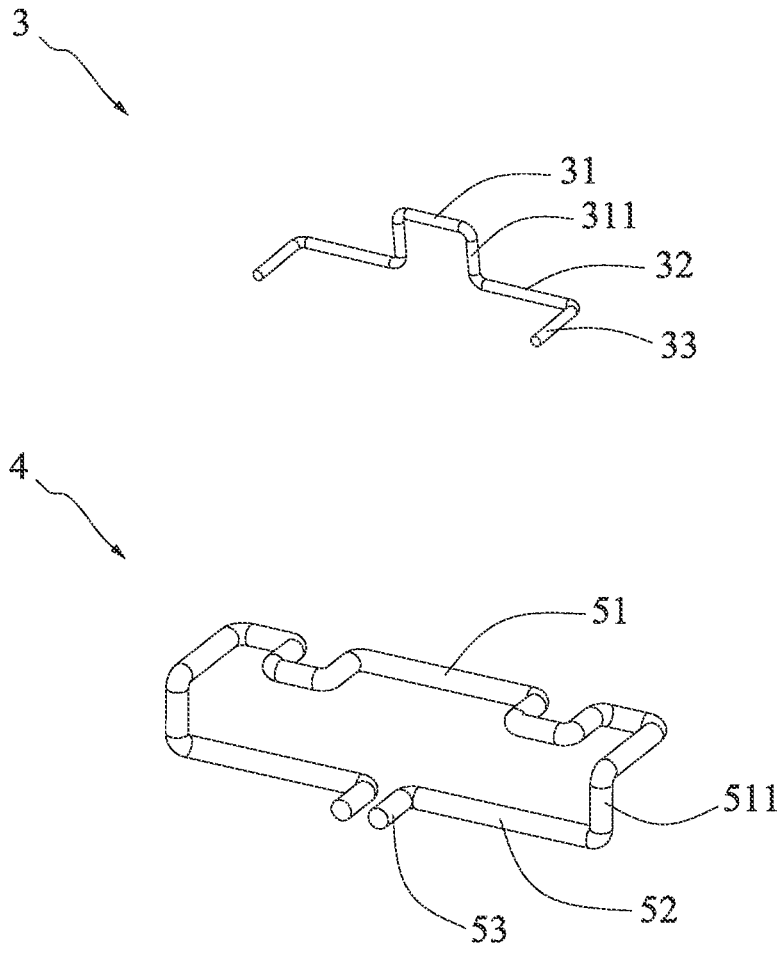
FIG. 4 is a schematic perspective view showing the resilient elements of the first and second embodiments.

Referring to FIGS. 2 and 4, the resilient element 3 is installed in the control device 2. In this preferable embodiment, the resilient element 3 is a spring made of a metal material. The resilient element 3 has a fixing portion 31, two deforming portions 32 and two contact portions 33, wherein the fixing portion 31 is fixed into the multiple position slots 221 and located at middle part of the accommodating space 200 (as shown in FIG. 1), and the fixing portion 31 has two bending portions 311 bending and extending from two opposite ends of the fixing portion 31, respectively. The deforming portions 32 extend from the bending portions 311 in opposite directions and are located with respect to the supporting walls 222 and adjacent to the opening 20, respectively. Namely, each bending portion 311 is between and connects the fixing portion 31 and the deforming portion 32. Both the deforming portion 32 and the fixing portion 31 are perpendicular to the bending portion 311. The two contact portions 33 bend and extend from free ends of the deforming portions 32 towards the pressing portions 23, respectively, wherein each of the contact portions 33 is located between respective pressing portion 23 and triggering device 6 and adjacent to the end portion 211.

Figure 3:
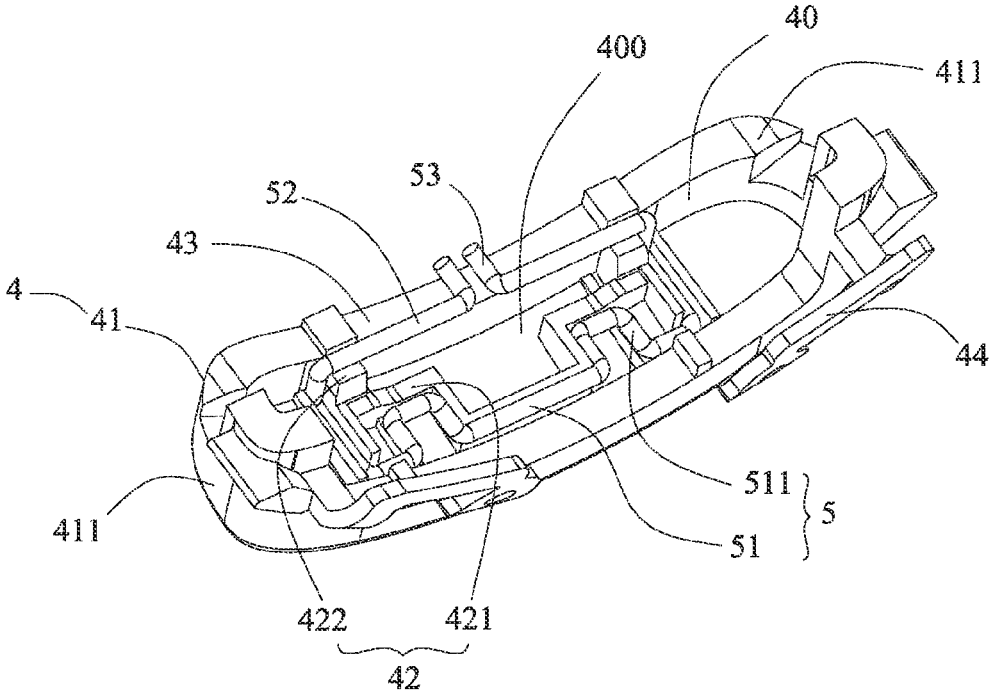
FIG. 3 is a schematic exploded perspective view showing a control device and a resilient element of a second embodiment of a switch apparatus of the present invention.

Referring to FIG. 3 showing a second embodiment of the present invention, the second and the first embodiments have many structures in common, and those same structures are not to be described in detail hereinafter. In the second embodiment, the switch apparatus 1 has a control device 4, a resilient element 5, the triggering device 6, and two retaining elements 8, wherein the control device 4 has a base portion 41, an opening 40, an accommodating space 400 communicating with the opening 40, a position portion 42, a pressing portions 43, and two linking portions 44. The base portion 41 has two opposite end portions 411, and the pressing portions 43 are formed adjacent to the opening 40. The position portion 42 is formed in the accommodating space 400, and has multiple position slots 421 and supporting walls 422, which are spaced away from each other. Each of the linking portions 44 comprises a fixing plate 441 and a linking bar 442 bending to form a substantially L shape, wherein one end of the linking bar 442 is connected to the fixing plate 441 that is firmly fixed onto the casing 91 of the electronic product (as shown in FIG. 5), and the other end of the linking bar 442 is connected to the base portion 41 and remains free together with the base portion 41. In the above manner, the linking bar 442 and the base portion 41 cooperatively forms a cantilever structure so that the base portion 41 is capable of being pressed downwards.

Referring to FIGS. 3 and 4, the resilient element 5 is installed in the control device 4. In this preferable embodiment, the resilient element 5 is a spring made of a metal material. The resilient element 5 has a fixing portion 51, two deforming portions 52 and two contact portions 53, wherein the fixing portion 51 is fixed into the multiple position slots 421 and located at middle part of the accommodating space 400 (as shown in FIG. 3), and the fixing portion 51 has two bending portions 511 bending and extending from two opposite ends of the fixing portion 51, respectively. The deforming portions 52 extend from the bending portions 511 towards each other and are located with respect to the supporting walls 422 and adjacent to the opening 40, respectively. Particularly, the two contact portions 52 in the second embodiment are located with respect to substantially middle part of the pressing portion 43.

Figure 6A:
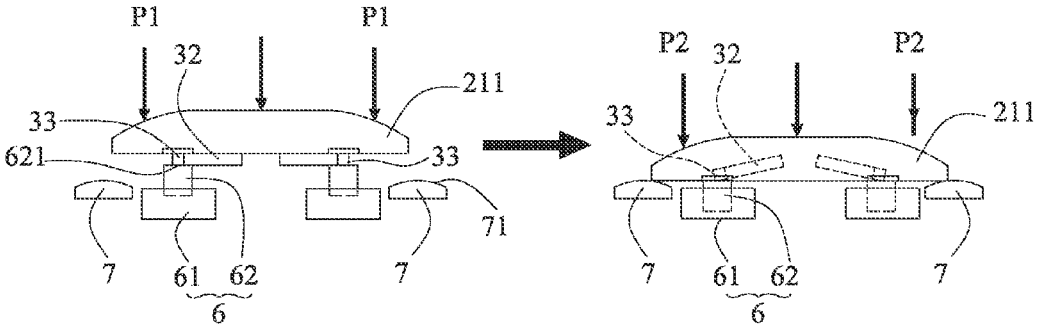
FIG. 6A is a schematic view showing operating processes of the switch apparatus of the first embodiment.
Figure 6B:
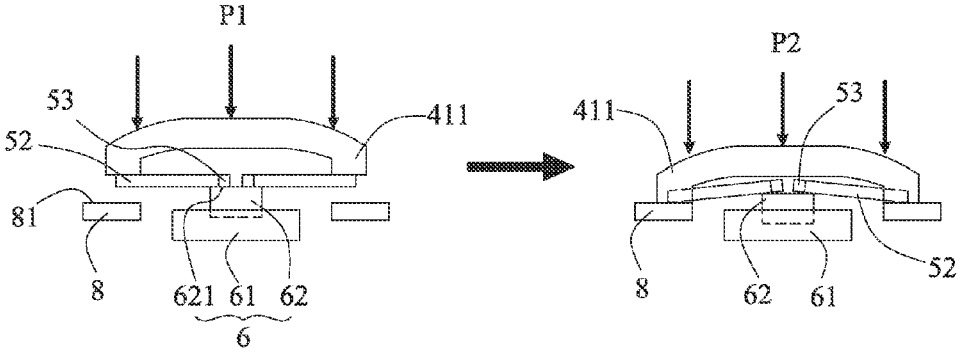
FIG. 6B is a schematic view showing operating processes of the switch apparatus of the second embodiment.

Referring to FIGS. 5 and 6A, 6B, in both the first and second embodiments, the triggering device 6 has a main body 61, a triggering element 62, and a connecting face 63, the triggering element 62 has the bearing surface 621 thereon for being pushed by the contact portions 33, 53 of the resilient element 3, 5, and the connecting face 63 is electrically connected to the printed circuit board 92 (as shown in FIG. 7). Accordingly, in the first embodiment, there are two triggering devices 6 separately disposed adjacent to the two contact portions 33, and in the second embodiment, there is only one triggering device 6 disposed adjacent to the two contact portions 53.

Continuing referring to FIGS. 5 and 6A, 6B, the switch apparatus 1 of the present invention further comprises the retaining elements 7, 8 located below the end portions 211, 411 of the base portion 21, 41, respectively. Each of the retaining elements 7, 8 has a board-like shape and a retaining face 71, 81, which is located lower than the bearing surface 621 of the triggering device 6 (as shown in FIGS. 5, 6A and 6B). In the first and second embodiments, the retaining elements 7, 8 are firmly attached to the casing 91 (as shown in FIG. 5), and are spaced apart from the control device 2, 4, respectively. Additionally, the retaining faces 71, 81 are being flat or arc (as shown in FIGS. 6A and 6B), and are located between the bearing face 621 and the main body 61.

Referring to FIG. 6A in combination with FIG. 5, FIG. 6A schematically shows operating processes of the switch apparatus 1 of the first embodiment. When the base portion 21 of the control device 2 is being pressed with a first force P1, the pressing portions 23 press against the contact portions 33 of the resilient element 3. Meanwhile, the bearing surfaces 621 of the triggering elements 62 are being pushed downwards by the contact portions 33 into the main bodies 61 so as to trigger the triggering devices 6, and the deforming portions 32 are not deformed. Alternatively, the control device 2 can be pressed on either one of the two end portions 211, and therefore only the respective triggering device 6 is being triggered.

When the control device 6 is continually being pressed with a second force P2 larger than the first force P1, the deforming portions 32 deform and bend inwardly of the accommodating space 200, and the contact portions 33 continue pressing against the bearing surfaces 621. At the same time, the end portions 211 of the base portion 21 move against the retaining faces 71 of the retaining elements 7. As a result, an excessive force applied on the control device 2 is effectively withstood by the retaining elements 7, which successfully retain the control device 2 and prevent it from keeping moving downwards and being damaged. When the second force P2 disappears, the deforming portions 32 return to their previous shapes and do not deform.

Referring to FIG. 6B in combination FIG. 5, the operating process of the switch apparatus 1 of the second embodiment is same as that of the first embodiment. When the base portion 41 of the control device 4 is being pressed with the first force P1, the pressing portion 43 presses against the contact portions 53 of the resilient element 5. Meanwhile, the bearing surface 621 of the triggering element 62 is being pushed downwards by the contact portions 53 into the main body 61 so as to trigger the triggering devices 6, and the deforming portions 52 are not deformed. Likewise, when the control device 4 is continually being pressed with the second force P2 larger than the first force P1, the deforming portions 52 deform and bend inwardly of the accommodating space 400, and the contact portions 53 continue pressing against the bearing surface 621. At the same time, the end portions 411 move against the retaining faces 81 of the retaining elements 8. As a result, an excessive force applied on the control device 4 is effectively withstood by the retaining elements 8.

Particularly, according to a testing result, a force to enable the triggering element 62 of the triggering device 6 to move is only 180 grams. That is, the first force P1 is defined to be smaller than a force of 400 grams which is certainly available to trigger the triggering device 6. Furthermore, the second force P2 is tested to be a force larger than 1 kilogram to enable a deformation of the deforming portion 32, 52 of the resilient element 3, 5.

Accordingly, the switch apparatus 1 of the present invention utilizes the resilient element, the spring, installed between the control device 2, 4 and the triggering device 6 to effectively buffer the impact from the control device 2, 4. Users can press any part of the control device 2, 4 with a same force to trigger the triggering device 6. Moreover, when the control device 2, 4 is being pressed with an excessive force, the excessive force is effectively withstood by the retaining elements 7, 8 so as prevent the switch apparatus 1 from being damaged and thus ensure the switch apparatus 1 operates normally.

It is understood that the invention may be embodied in other forms within the scope of the claims. Thus the present examples and embodiments are to be considered in all respects as illustrative, and not restrictive, of the invention defined by the claims.

What is claimed is:

1. A switch apparatus adapted to be assembled with a casing of an electronic product, comprising:

a control device comprising a base portion having two opposite end portions, an opening, an accommodating space communicating with the opening and defined in the base portion, a position portion, at least a pressing portion formed on a side of the base portion adjacent to the opening, and at least a linking portion having one end connected to the casing of the electronic product;

a resilient element being installed in the control device, and having a fixing portion, at least a deforming portion and a contact portion extending from a free end of the at least a deforming portion, the fixing portion being fixed into the position portion and bent to form the at least a deforming portion, the at least a contact portion located with respect to the pressing portion of the control device; and at least a triggering device being electrically connected with the electronic product, and having a bearing surface facing the contact portion of the resilient element;

wherein when the control device is being pressed with a first force, the at least a pressing portion presses against the contact portion of the resilient element, whereby the bearing surface of the at least a triggering device is being pushed downwards by the contact portion so as to trigger the at least a triggering device, while the control device is being pressed with a second force larger than the first force, the at least a deforming portion deforms, and the contact portion continues pressing against the bearing surface.

2. The switch apparatus of claim 1, wherein the resilient element is a spring and has two the deforming portions and the contact portions, the fixing portion further includes two bending portions extending and bending from two opposite ends of the fixing portion, and the deforming portions extend from the bending portions and are located adjacent to the opening.

3. The switch apparatus of claim 1, further comprising two retaining elements attached to the casing of the electronic product with respect to the two end portions of the base portion, respectively, each of the retaining elements has a retaining face located lower than the bearing surface of the at least a triggering device, and when the control device is under the second force, the end portion moves against the retaining face.

4. The switch apparatus of claim 3, wherein the at least a triggering device has a main body, a triggering element, and a connecting face, the triggering element has the bearing surface thereon for being pushed by the contact portion of the resilient element, the connecting face electrically connected to the electronic product, and the retaining face of the retaining element is located between the bearing surface and the main body.

5. The switch apparatus of claim 3, wherein the retaining face is an arc face.

6. The switch apparatus of claim 1, wherein the linking portion of the control device comprises a fixing plate and a linking bar bending to form a substantially L shape, one end of the linking bar is connected to the fixing plate, the other end of the linking bar is connected to the base portion, and the fixing plate is fixed onto the casing of the electronic product.

7. The switch apparatus of claim 1, wherein the position portion has at least a position slot and a supporting wall, the fixing portion of the resilient element is fixed into the position slot, and the deforming portion is located adjacent to the supporting wall.

8. The switch apparatus of claim 1, wherein the fixing portion of the resilient element is located at middle part of the accommodating space.

9. The switch apparatus of claim 1, wherein the first force is smaller than a force of 400 grams.

10. The switch apparatus of claim 1, wherein the second force is larger than a force of 1 kilogram.

* * * * *